United States Patent [19]

Hanscom

[11] 4,362,096

[45] Dec. 7, 1982

[54] TYING MACHINE

[75] Inventor: John F. Hanscom, Rehoboth, Mass.

[73] Assignee: H. F. Hanscom & Company, Inc., Providence, R.I.

[21] Appl. No.: 233,931

[22] Filed: Feb. 12, 1981

[51] Int. Cl.[3] ..... B65B 13/16

[52] U.S. Cl. ..... 100/10; 100/31

[58] Field of Search ..... 100/10, 31; 53/590; 140/93.6; 56/451, 456, 457

[56] References Cited

U.S. PATENT DOCUMENTS

| | | | |
|---|---|---|---|
| 1,261,589 | 4/1918 | Mogan | 100/31 X |
| 2,770,183 | 11/1956 | Hanscom | 100/31 X |
| 3,318,230 | 5/1967 | Hilton | 100/31 X |

FOREIGN PATENT DOCUMENTS

| | | | |
|---|---|---|---|
| 2395895 | 3/1979 | France | 100/31 |
| 1236984 | 6/1971 | United Kingdom | 100/31 |

*Primary Examiner*—Billy J. Wilhite

*Attorney, Agent, or Firm*—Barlow & Barlow

[57] ABSTRACT

A tying machine for tying articles of varying size utilizing tying material is disclosed that has a pair of normally spaced rotatable gripping devices, tying material being fed to the rotatable gripping devices in a pre-adjusted controlled length, said gripping devices moving together maintaining a grip on the ends of the tying material and then rotating to twist the material together about the article.

4 Claims, 10 Drawing Figures

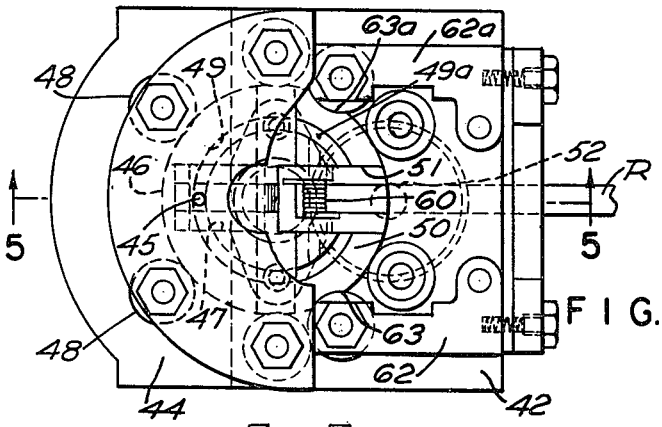
FIG. 4
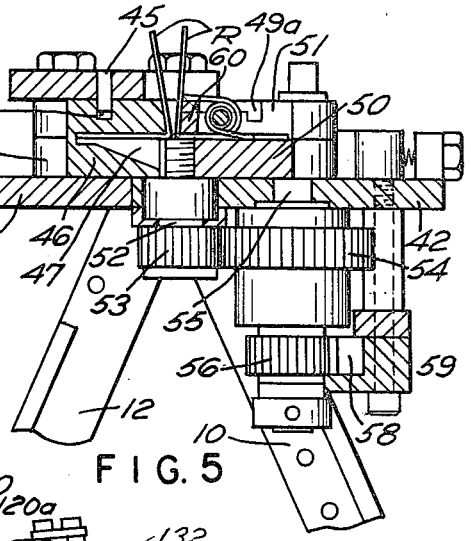
FIG. 5
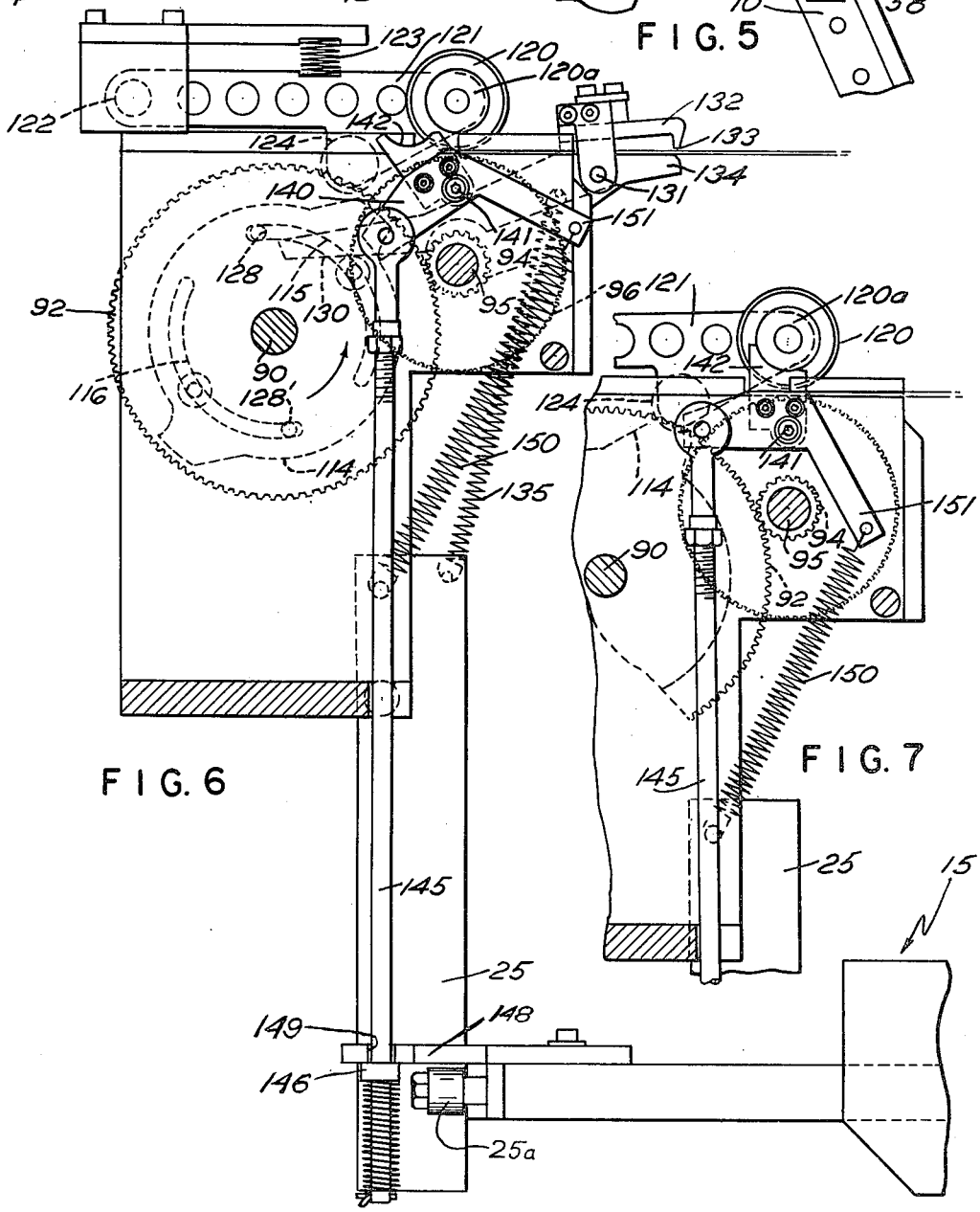
FIG. 6
FIG. 7

TYING MACHINE

BACKGROUND OF THE INVENTION

The present machine is an improvement over the tying machine disclosed in U.S. Pat. No. 2,770,183 dated Nov. 13, 1956. The present machine incorporates an improved tying mechanism that eliminates the need for rotating massive arms.

In the prior art there are devices for feeding tying material about objects to be tied and picking up the loose ends of the tying material and spinning the same into locking position as seen for example in the Mogan U.S. Pat. No. 1,261,589. The Hilton patent, U.S. Pat. No. 3,318,230 is a further example of utilizing tying material which is directed around a predetermined path into clamps which then rotate to twist the tying material together. It is important, however, to have adaptability of article sizes to be tied and a means for drawing the tying material about the article and then twisting the same. For example, it is desired to bundle coils of garden hose and coils of electrical cable which vary in size and often in configuration as they are loose bundles when they come to the tying station.

SUMMARY OF THE INVENTION

The present invention provides a tying machine for tying articles of varying size with a pair of normally spaced apart gripping devices. Tying material is delivered from a source, such as a spool, and is fed from one device to the other in a length sufficient to encompass the article to be tied, which in many cases will provide a loop of material extending away from the gripper element. The gripping devices are moved about the article to be tied and then each gripper element is moved in toward each other so that they abut. When the gripping devices abut, means are provided for rotating the devices in unison so as to twist the ends of the tying material together.

In its preferred organization, the apparatus for tying articles envisions mounting the gripping devices or grippers on the ends of arms that are arranged to pivot in such a way that the ends mounting the gripper elements will move toward each other, and indeed the arms will also move relative to the article so as to draw the tying material about the article. The mechanism also comprehends a feeding bridge for guiding the tying material from the first gripper element mounted on the end of one of the arms to the second gripper element, and thence allowing the tying material to loop as the necessary tying material is fed, whereupon the tying material is cut as desired. The gripping elements descend about the article and are brought together so that the tying material is about the article, and then the bridge withdraws. Means are provided to rotate the gripping elements in unison and since each of the gripper elements holds one of the ends of the tying material, it will be apparent that this rotation will cause the tying material to twist about itself and suitably grip the article.

BRIEF DESCRIPTION OF THE DRAWINGS

FIG. 4 is an enlarged top plan view of the upper ends of the tying arms with the grippers in the closed position as seen in FIG. 2;

FIG. 5 is a sectional view taken on lines 5—5 of FIG. 4;

FIG. 6 is an enlarged side elevational view taken from the opposite side of FIG. 1 showing the mechanism for feeding the tying material;

FIG. 7 is a similar view showing the follower roll raised from feeding position;

DESCRIPTION OF THE PREFERRED EMBODIMENT

Figure 1:
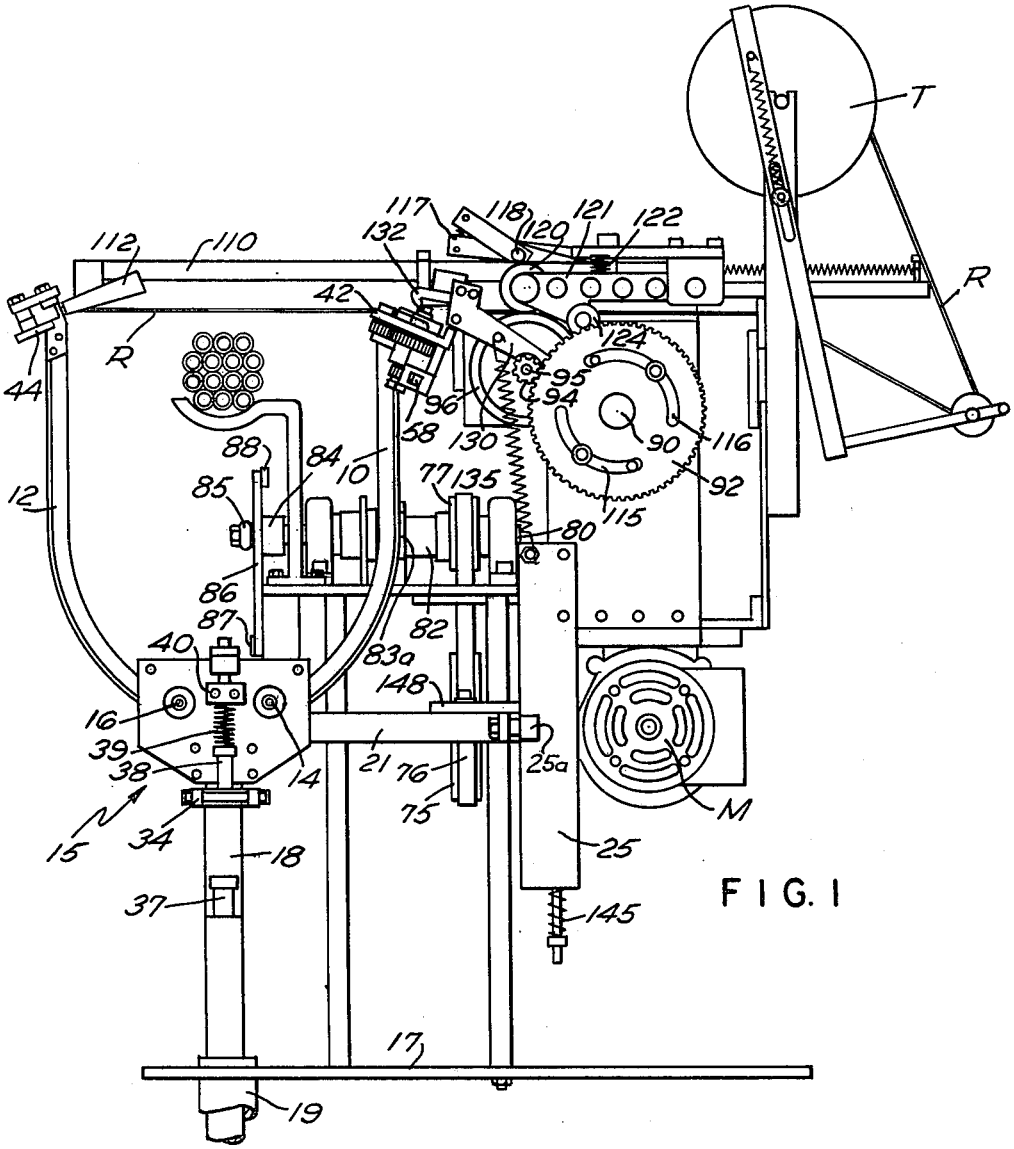
FIG. 1 is a side elevational view of the tying machine of the instant invention showing the material feeding bridge extended across the tying arms and a portion of an article to be tied supported in position between the arms.

As seen in FIG. 1, the device has a pair of tying arms 10 and 12, which are pivotally mounted as at 14 and 16, respectively, to a reciprocal carriage or common support generally designated 15. The carriage is mounted on a vertically oriented post 18 which extends downwardly through a base plate 17 having a guide bushing 19. The lower end of the post 18 has a coupling block 20 (see FIG. 3) attached thereto which slidably engages actuating lever 22. To reciprocate the lever 22 and in turn the tying arms, there is provided a power source 24 which could be in the form of an electric motor that through suitable gear reductions rotates a cam 26. Lever 22, which is pivoted as at 23 to the frame for the apparatus is provided with a cam follower 28 to engage the cam 26, and as can be readily appreciated, with an hourglass cam configuration, a 180° revolution of the cam 26 will cause the tying arms to go through a complete up and down movement. The carriage is maintained in a non-rotative position with a guide bracket 21 with a pair of rollers 25*a* on either side of and engaging a fixed plate 25.

Figure 3:
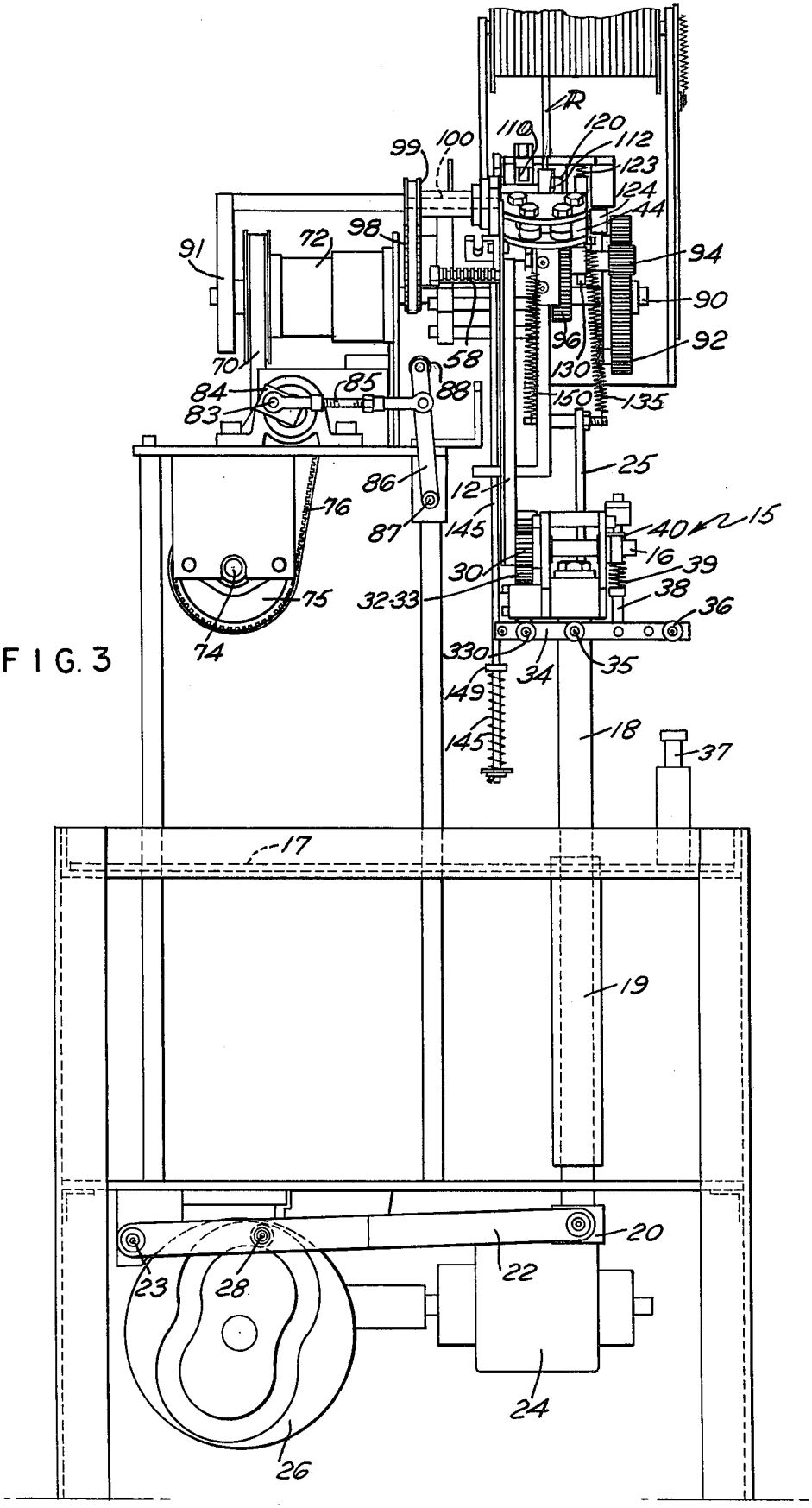
FIG. 3 is a front elevational view showing the tying arms in the position of FIG. 1.

The carriage 15 for the arms 10, 12 has, as previously noted, a pivot for the arms which takes the form of a pair of shafts 14, 16 which extend through the mounting plates and have affixed thereto gears 30 (FIG. 3). In order to have rotation in unison, a pair of gears 32, 33 are coupled by a common rack (not shown) as at 33*a*, to a lever 34 that is pivoted on the post 18 as at 35, in a first class lever format, and has an actuating end in the form of a roller 36 that engages post 37. The lever 34 between pivot 35 and roll 36 is normally biased in a downward direction by a spring loaded post 38 which is coupled to the lever and to the assembly 15, bias being achieved by a spring 39 that acts against a fixed guide block 40.

Referring to the upper end of each arm as seen in FIGS. 4 and 5, there is mounted a gripping device which consists basically of a pair of plates 42 and 44 mounted respectively on the arms 10 and 12. Revolvably mounted on the plate 44 is a semi-circular member defining a receiving gripper 46 having a slot 47 that is suitably held for rotation as for example by roller post 48 and pin 45 engaging slot 49, and similarly there is a conjugate semi-circular member or gripper 50 having a thru slot 51 mounted for rotation on the plate 42 and held for rotation in a similar fashion. Gripper 50 has a shaft 52 depending therefrom to which is attached a gear 53 that is coupled via gears to a rack 58 suitably held for slidable mounting in a guideway 59. More particularly, it will be noted that the gripper 50 is mounted for rotation on a shaft 52 that carries a gear 53 which in turn meshes with the gear 54 mounted on a shaft 55 that is journaled in plate 42. Also mounted on the shaft 55 is a gear and ratchet mechanism 56 that engages a rack 58 suitably held for slidable movement in guideways 59. Movement of rack 58 will through gears 56, 54 and 53 rotate both grippers 46, 50 that are guided by a plurality of roller posts 48 and guide pin 45 that engages slot 49, 49*a*. As will presently appear, the gripper 50 is fitted with a tying material receiving slot 51 and within the slot there is contained a spring pawl 60 that will prevent the tying material from receding to the right as seen in FIG. 5 of the drawing. Also it will be noted that the gripper 50 is provided with justifying means in the form of a pair of spring loaded pawls 62, 62*a* which engage respectively recesses 63, 63*a* in the side walls of member 50.

Figure 5A:
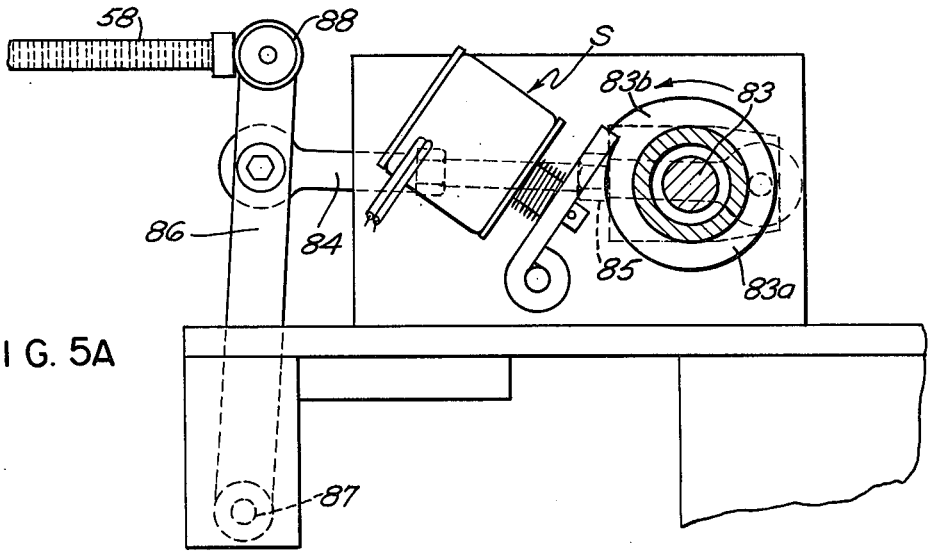
FIG. 5A is an enlarged detail view looking at the front of the machine showing the actuating means for moving the rack that revolves the grippers.
Figure 2:
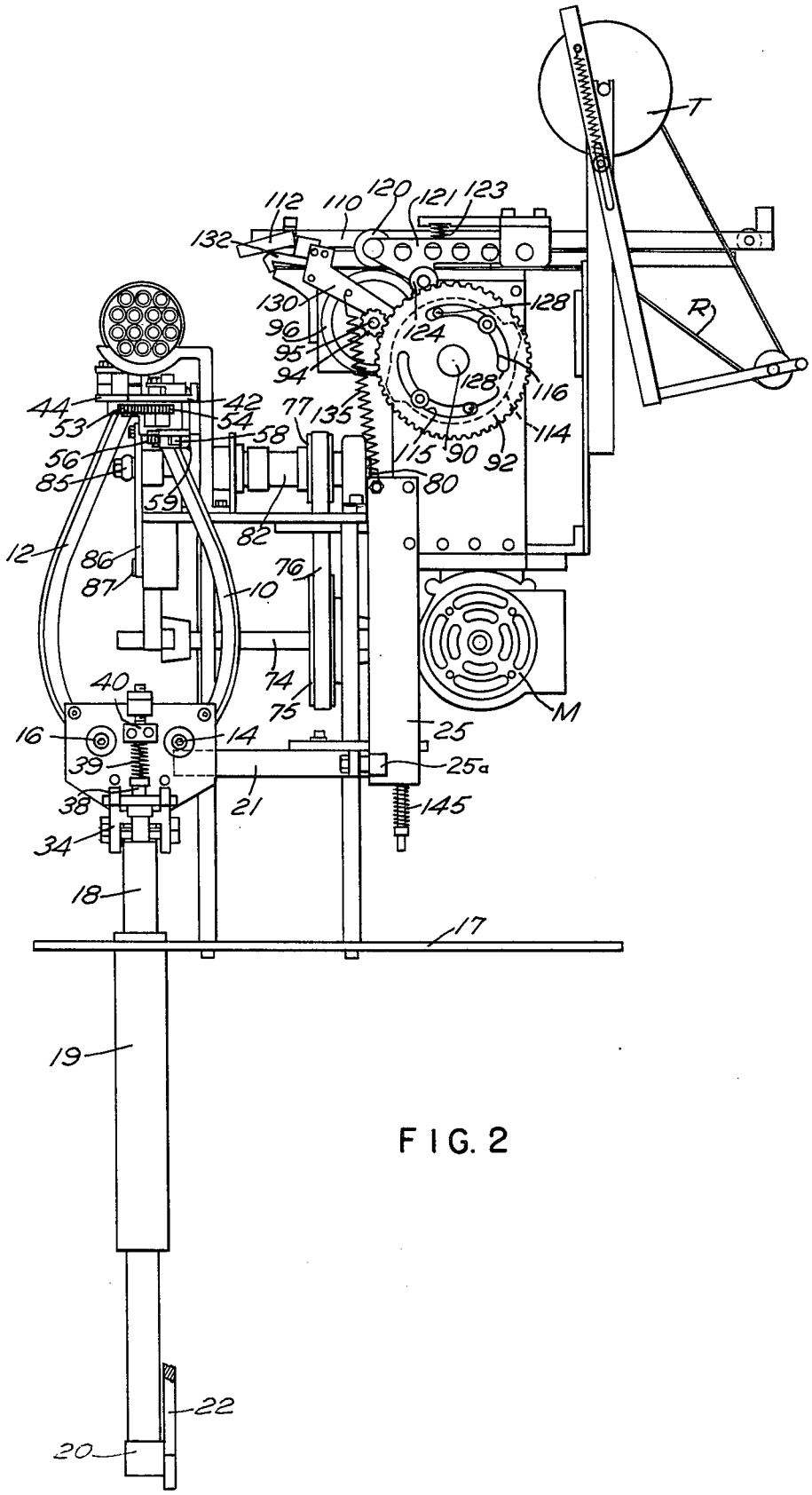
FIG. 2 is a similar view to FIG. 1 showing the arms in a second position where tying of the material occurs.

When the grippers are in the tying position, which is as seen in FIGS. 2, 4 and 5, they will rotate about their common center, which may be defined by the axis of shaft 52, rotation being achieved by movement of the rack 58. Rack 58 is seen in FIG. 5A as engaging a roller 88 that is mounted on the end of a lever 86 that is pivoted as at 87 to the frame of the machine. An actuating crank arm 84, that has an adjustment nut 85 thereon to provide fine adjustment of the position of the roller 88, is connected to a revolvable plate 83*a* that is fixedly mounted on shaft 83. Also fixedly mounted on shaft 83 is a stop plate 83*b* which is in the form of a cam that is locked by a spring loaded solenoid S to prevent unwanted action of the lever 86. Under normal conditions, the shaft 83, which is the output shaft of a one-shot clutch 82 (see FIGS. 1 and 2), will be actuated on command, the drive for the one-shot clutch being a continuous drive achieved through a belt 76 that connects sheaves 75 and 77, the latter being mounted on shaft 80, the drive of sheave 75 being achieved through a right angle drive (not shown) from the motor M.

Figure 8:
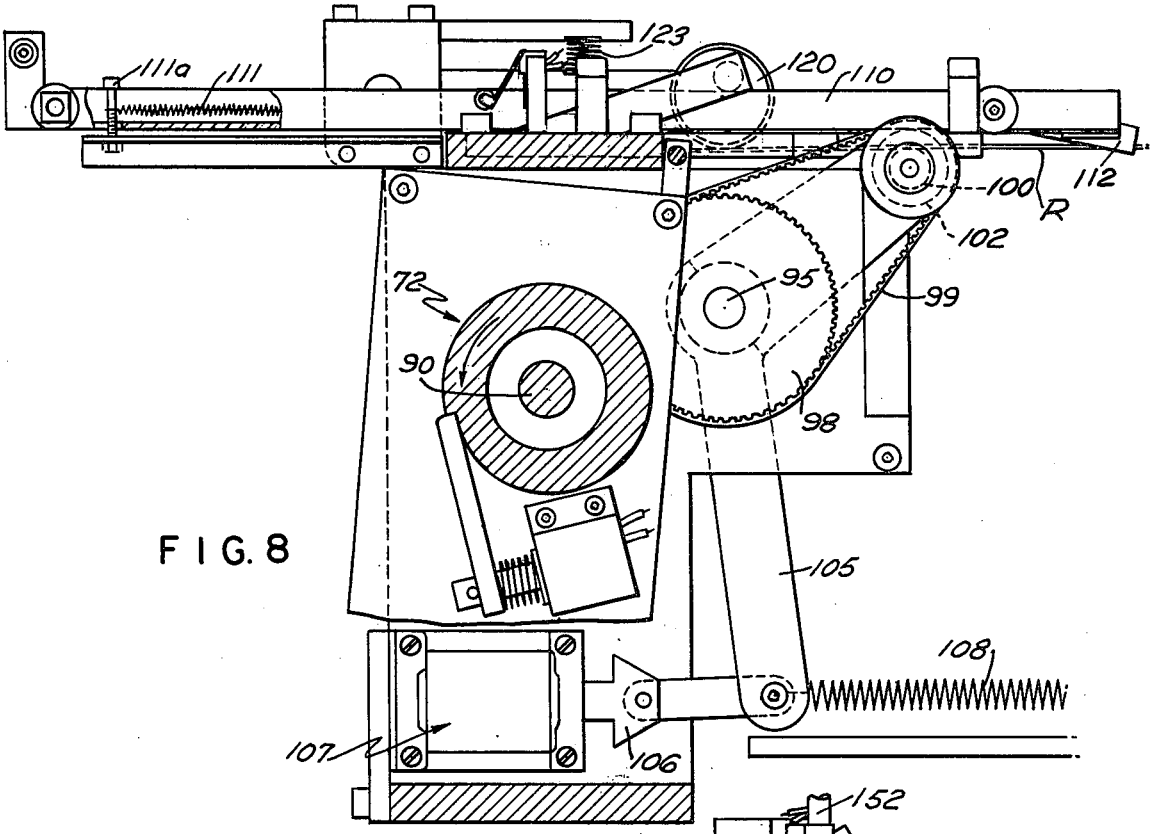
FIG. 8 and FIG. 9 are diagrammatic views showing the material feeding operating parts in feed and non-feed positions, a latch eliminated from FIG. 8 for clarity.
Figure 9:
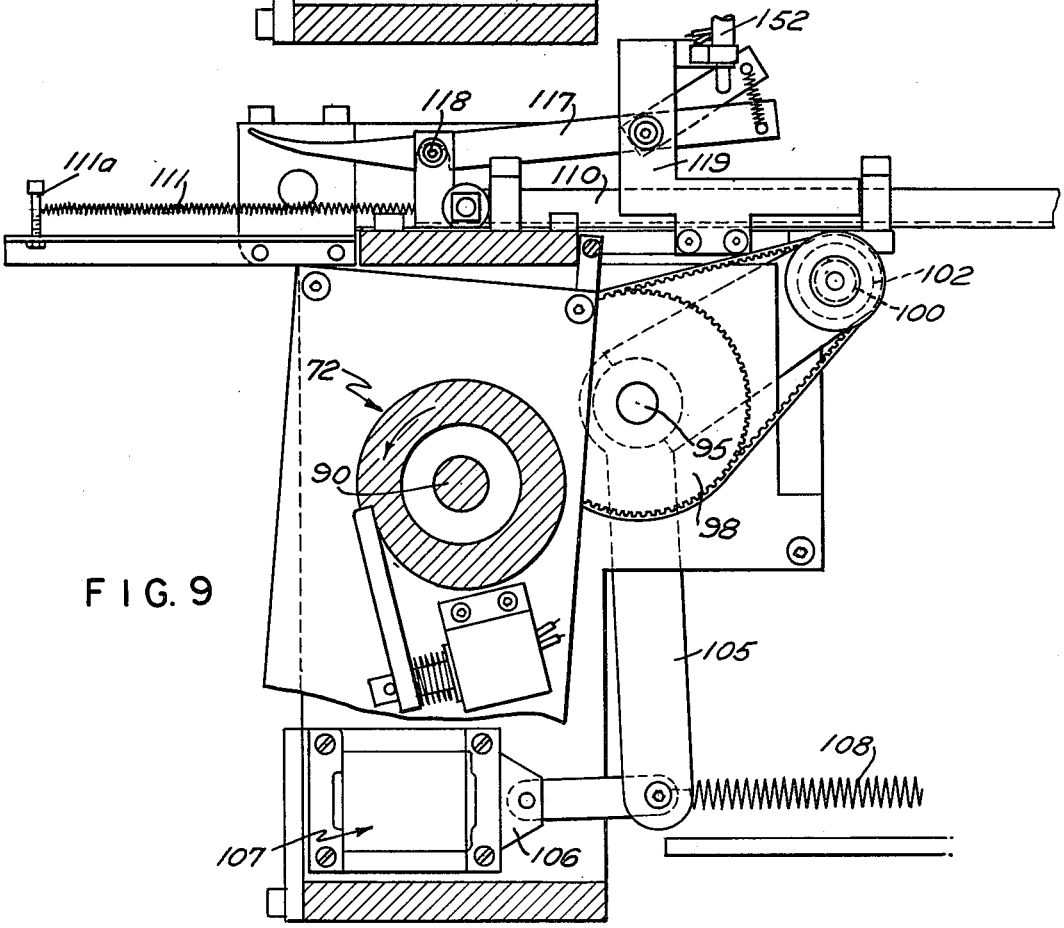

Tape Feed - For feeding tying material from a supply spool T as seen in FIG. 1 for example, the material R is fed downwardly over a guide roller and is guided on top of a serrated ribbon feed wheel 96, which controls its forward movement. Referring now more particularly to FIGS. 6, 8 and 9, the drive for the feed wheel eminates from a belt 70 that leads from motor M and thence to a one-shot clutch 72 that has an output shaft 90 which is mounted in bearings such as 91 (FIG. 3) that passes through the framework of the apparatus to be directly coupled to a gear 92 (FIG. 2). Gear 92 drives a pinion 94 that is coupled to a shaft 95 that carries the feed wheel 96 (FIGS. 1, 2). Adjustable cam dog 114, which may be adjusted for arcuate position in slots 115 and 116 of gear 92 as in FIGS. 2, 6 and 7, serves to engage and disengage a cam follower roll 124. As will be seen, a feed pressure roll 120 is mounted on the end of an arm 121 that is pivoted as at 122 and is normally urged in a downward direction, as seen in the drawings, by a spring means 123 (FIG. 1). The lower end of the arm 121 carries a cam follower 124 which will engage the cam 114 at a suitable point in the cycle time, which will be described subsequently, the cam 114 lifts the lever 121 and disengages the material feed. It will be apparent that by adjusting the position of the dogs 114, the length of the material fed may be pre-selected as desired.

Description of Bridge Operation - As was noted above, the tying material is advanced by a feed wheel 96 which is coupled to shaft 95. Also mounted on shaft 95 is a sheave 98 which, through a belt coupling 99, drives a shaft 100 that is connected to a serrated bridge drive roller 102.

By referring to FIG. 8, it would be seen that the shaft 100 to which the drive roller 102 is connected is mounted on a crank arm 105 which rocks about shaft 95 and is coupled to an actuating device in the form of the armature 106 of a solenoid generally designated 107 which includes a bias spring 108 that normally urges the roller 102 into engagement with a guide bridge 110.

The guide bridge 110 is utilized to assist the feed of the tying material across a large open space and to this end consists of a bar-like member which is illustrated as being U-shaped in cross section and which carries at the far end thereof a guide means or channel 112 as seen in FIG. 1 that extends laterally of the bridge member 110 and in line with the grippers 46 and 50 and more particularly their receiving grooves 51 and 47.

Within the channel of the arm 110 it will be seen that there is a spring 111 which is mounted to the frame as at anchor point 111*a*. Also the bridge arm 110 has a latch 117 that engages a roll pin 118 on the end of the arm, the latch member 117 being pivotally mounted on a bracket 119 fastened to the frame. Means such as a solenoid 152 will on command raise the latch and permit the bridge to return to its at-rest position as seen in FIG. 8.

Referring to FIG. 2, the arrangement is such that as the gear 92 revolves it, as noted, drives through pinion 94, shaft 95 and in turn roller 102 for driving the bridge. The ratio of the gears and sheaves as related to the drive surface of roller 103 is such that the bridge 110 will move forwardly at the same rate that the tying material is being urged forwardly so as to keep in step therewith. At the end of the advance of the material into the gripper 46 and its receiving slot 47, for example, there are a pair of pins 128, 128' (see FIG. 6) that are located on the cam 114 and these pins as they revolve around will engage lever 130 that is pivoted as at 131 and which carries at its far end as a suitable extension thereof, a cut-off knife 132 whose cutting edge 133 cooperates with an anvil block 134. The arrangement is such that within each one-half revolution of the gear 92 the cut-off knife will operate, but in each cycle the tying material has advanced as necessary to a degree as determined by the location of the dogs 114.

To insure that during further sequences in the cycle of the apparatus that the tape remains disengaged from feed roller 96, there is provided a lever 140 pivoted at 141 that carries an arcuate block 142. The arcuate block is in a lateral position to engage the shaft on which the feed pressure roll 120 is mounted. As seen in FIG. 7, to achieve this there is an actuating rod 145 that extends downwardly and has a spring loaded engagement cylinder 146 (FIG. 6) affixed thereto. A plate 148 having a slot 149 that rides on the rod 145 is attached to the jaw assembly as by the carriage 15. As will be seen in FIG. 7, a spring 150 is coupled to an arm 151 extension of the lever 140 to normally maintain the arcuate block 142 under a roller 120*a* of feed pressure roll 120. Disengagement is provided by downward motion of the carriage 15 which has sufficient force to overcome the tension in spring 150.

Description of the Operation - Starting at a datum position in which the tying arms and the carriage 15 are located slightly higher than as seen in FIG. 2, it will be appreciated that at this location the tying arms will be open and as the roller 36 will no longer be in engagement with the post 37. The tying arms will then move upward by the action of the cam 26 moving arm 22 to be in position as seen in FIGS. 1 and 3. The arms are in line with the guide 112 on bridge 110. At this point, assuming that the article to be wrapped is in position on the support, the one-shot clutch 72 will be actuated and this in turn will cause rotation of the shaft 90 as well as shaft 95 and 100, that will rotate the material feed wheel 96 feeding tie stock material and at the same time and in step therewith will feed the bridge 110, the tie stock being gripped in guide 112. With the tie stock and the bridge moving in unison, the tie stock is first fed through the slot 51 and thence moves up under the U-shaped bridge where it is picked up to be guided over to the slot 47. The forward movement of the bridge 110 is stopped as its position may be sensed as by a sensitive switch to actuate solenoid 104 that will rock the crank arm 105 and disengage the drive roller 102. The feed of the tying stock, however, is not necessarily stopped at this point. Here it is desired to have the tie buckle up a sufficient amount to wrap the article. The feed of the tie is controlled by the cam dog 114 which will come around and engage a cam follower 124 to raise the feed pressure wheel 120 as seen in FIG. 7 of the drawings. At the same time, there are a pair of pins 128, 128', one of which will engage lever 130 and actuate the cut-off knife 132.

Now that the tie extends between the grippers 46 and 50 the arms 10 and 12 may descend by the actuation of the cam 26. When the arms reach the bottom stroke, roller 36 will engage post 37 and move the arms together so that the grippers 46 and 50 are in the position as seen in FIGS. 4 and 5. This now locks the two ends of the tie material together. At the same point in time, the latch 117 releases the bridge 110 so that it drops back to position as seen in FIG. 2. One-shot clutch 82 now actuates, along with solenoid S which will allow shaft 83 to rotate in a counter-clockwise direction as seen in FIG. 5A, that in turn will push the rack 58 to the left as seen in FIG. 5A and cause rotation of the grippers about their common center, twisting the tying stock, one end about the other. Effectively, the gearing is such that the grippers 46 and 50 will rotate at least two revolutions. The lever 86 is now back into the normal position as seen in FIG. 5A, the solenoid S stopping further rotation of the shaft 83 and the one-shot clutch is disengaged. The rack is pulled back into initial position under urgance of a spring (not shown). The arms now raise one inch so that the rack 58 is completely disengaged from the roller 88. The grippers 46 and 50 re-justify themselves in position with the assistance of the rollers **63, 63*a* as seen in FIG. 4, and as the grippers move up slightly above the position as seen in FIG. 2, they will open, the ends of the tying material will slip out of the slots 47 and 51**, and the device is now ready for the next cycle.

I claim:

1. A tying machine for tying articles of varying size with material comprising a pair of arms mounted for pivotal movement in a single plane whereby the ends of the arms may be moved together, means for continuously maintaining said arms in a non-rotative position, a pair of spaced grippers for gripping tying material, said grippers mounted on the ends of said pair of arms and comprising substantially semi-circular members, means feeding tying material to said grippers, means cutting a preselected length of ribbon material, means causing relative movement of said grippers and said articles, means rocking said arms to move the grippers together, and means rotating the grippers about a common axis to twist the material about itself and around the articles.

2. A tying machine as in claim 1 wherein the means rotating the grippers is a shaft coupled to one gripper, guide means being provided to permit the grippers to rotate with substantial circular motion.

3. A tying machine as in claim 1 wherein a guide bridge is provided, means advancing said bridge at the same rate as tying material is fed to said grippers and having guide means that are adapted to grip and guide the material between the spaced grippers.

4. A tying machine as in claim 3 including a latch to hold the bridge in extended position for a predetermined time interval.

* * * * *